US011085287B2

(12) United States Patent
Hjulstad et al.

(10) Patent No.: US 11,085,287 B2
(45) Date of Patent: Aug. 10, 2021

(54) MEASUREMENT OF CEMENT PROPERTIES

(71) Applicant: STATOIL PETROLEUM AS, Stavanger (NO)

(72) Inventors: Åsmund Hjulstad, Bru (NO); Jan Ove Brevik, Bergen (NO)

(73) Assignee: STATOIL PETROLEUM AS, Stavanger (NO)

( * ) Notice: Subject to any disclaimer, the term of this patent is extended or adjusted under 35 U.S.C. 154(b) by 378 days.

(21) Appl. No.: 15/755,921

(22) PCT Filed: Aug. 26, 2016

(86) PCT No.: PCT/NO2016/050176
§ 371 (c)(1),
(2) Date: Feb. 27, 2018

(87) PCT Pub. No.: WO2017/039455
PCT Pub. Date: Mar. 9, 2017

(65) Prior Publication Data

US 2018/0328162 A1 Nov. 15, 2018

(30) Foreign Application Priority Data

Aug. 28, 2015 (GB) ..... 1515365.3

(51) Int. Cl.
*E21B 33/14* (2006.01)
*E21B 47/005* (2012.01)
(Continued)

(52) U.S. Cl.
CPC ..... *E21B 47/005* (2020.05); *E21B 33/14* (2013.01); *E21B 47/06* (2013.01); *E21B 47/07* (2020.05)

(58) Field of Classification Search
CPC ..... E21B 33/14; E21B 47/06; E21B 47/065
(Continued)

(56) References Cited

U.S. PATENT DOCUMENTS 3,981,202 A 9/1976 Spangle
4,571,993 A 2/1986 St. Onge
(Continued)

FOREIGN PATENT DOCUMENTS

FR 2493927 11/1980
NO 20121023 9/2012
(Continued)

OTHER PUBLICATIONS

Muhammad Imam, Aftab Ahmad, Mehaboob Basha, Syed Shaahid, Luai Al-Hadhrami; "Effect of Viscosity On the Pressure Gradient in 4-Inch Pipe;" Nov. 2014; Proceedings of IMECE14; 2014 ASME International Mechanical Engineering Congress and Exposition, pp. 1-6. (Year: 2014).*
(Continued)

*Primary Examiner* — Mohamed Charioui
*Assistant Examiner* — Christine Y Liao
(74) *Attorney, Agent, or Firm* — Wenderoth, Lind & Ponack, L.L.P.

(57) ABSTRACT

A method of measuring the viscosity of cement slurry used for a primary cementing of an oil or gas well includes pumping the cement slurry along a conduit to a cementing location, measuring a first pressure loss along a first, horizontal portion of the conduit and a second pressure loss along a second, vertical portion of the conduit, and calculating a viscosity of the cement slurry based at least in part on the first and second pressure losses and a flow rate of the cement slurry.

11 Claims, 1 Drawing Sheet

(51) Int. Cl.
*E21B 47/07* (2012.01)
*E21B 47/06* (2012.01)

(58) Field of Classification Search
USPC ..... 702/6
See application file for complete search history.

(56) References Cited

U.S. PATENT DOCUMENTS

| | | | | |
|---|---|---|---|---|
| 6,176,323 | B1 | 1/2001 | Weirich et al. | |
| 2014/0202772 | A1* | 7/2014 | Kulkarni | E21B 21/08 175/65 |
| 2014/0260560 | A1 | 9/2014 | Zamora | |
| 2014/0269144 | A1 | 9/2014 | Ayo et al. | |
| 2015/0021028 | A1 | 1/2015 | Boekholtz et al. | |
| 2015/0112040 | A1* | 4/2015 | Shaw | C08G 69/30 528/308.3 |

FOREIGN PATENT DOCUMENTS

| | | |
|---|---|---|
| NO | 20121168 | 10/2012 |
| WO | 01/02832 | 1/2001 |
| WO | 2014/035552 | 3/2014 |
| WO | 2014/144206 | 9/2014 |
| WO | 2015/068154 | 5/2015 |

OTHER PUBLICATIONS

C.E. Cooke Jr, M.P. Kluck, R. Medrano; "Field Measurements of Annular Pressure and Temperature During Primary Cementing;" Aug. 1983; Society of Petroleum Engineers of AIME; pp. 1429-1438. (Year: 1983).*

Jae Hong Kim, Seung Hee Kwon, Shiho Kawashima, Hong Jae Yim; "Rheology of cement paste under high pressure;" Apr. 7, 2015; Elsevier, pp. 60-67. (Year: 2015).*

International Search Report dated Nov. 18, 2016 in International Application No. PCT/NO2016/050176.

Written Opinion of the International Searching Authority dated Nov. 18, 2016 in International Application No. PCT/NO/2016/050176.

Patents Act 1977: Search Report under Section 17(5) issued by the UK-IPO dated Dec. 10, 2015 in corresponding Great Britain Application No. 1515365.3.

A. Pattinasarany and S. Irawan, "The Novel Method to Estimate of Cement Slurry Consistency toward Friction Pressure in Oil/Gas Well Cementing", Research Journal of Applied Sciences, Engineering and Technology 4(22): 4596-4606, Nov. 15, 2012.

Examination Report No. 1 for Standard Patent Application dated May 31, 2018 in Australian Application No. 2016316560.

* cited by examiner

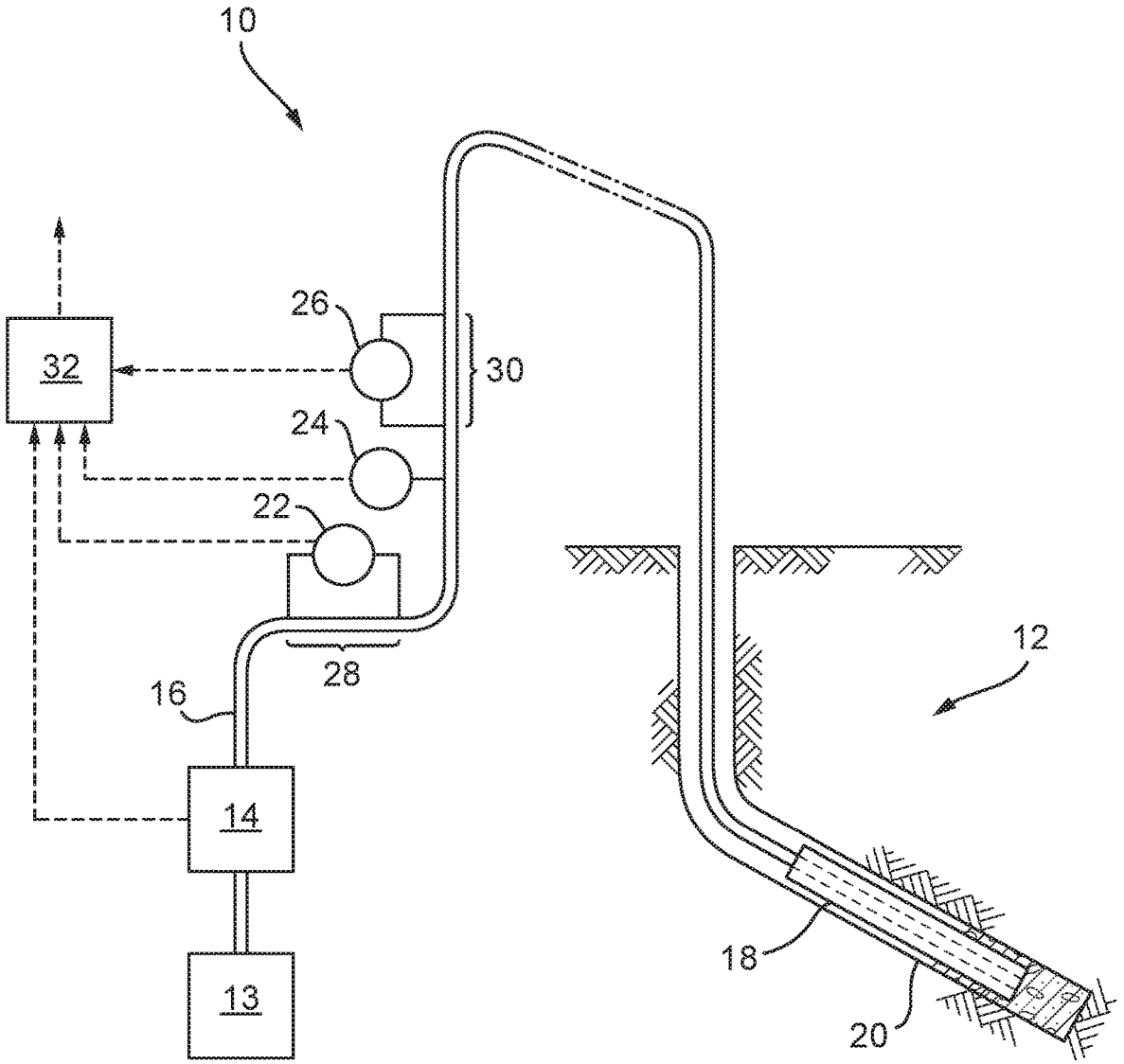
10
26
30
32
24
22
28
16
12
14
13
18
20

MEASUREMENT OF CEMENT PROPERTIES

The present it relates to the measurement of cement properties when cementing a well casing, and particularly to the automated measurement of cement viscosity without the use of laboratory equipment.

In a normal drilling process, a bore is drilled into the ground using a drilling head attached to a hollow drill string. Drilling fluid, typically a special mud referred to as drilling mud, is pumped down the drill string and used to cool and lubricate the drilling bit, carry the rock cuttings back to the surface, and maintain a suitable pressure in the borehole to stabilise to the borehole walls. Once the hole extends past the deepest freshwater aquifer (typically 100 to 300 metres), the drill string and drilling head are removed and replaced with a pipe, called a casing.

Next, cement slurry is pumped into the casing, and then drilling mud is pumped in behind the cement slurry to force the cement slurry down through the inside of the casing, out through a casing shoe at the bottom of the casing, and up into the annulus between the casing and the borehole well. As it is forced into the annulus, the cement slurry pushes the drilling mud out of the annulus and fills this space, where it sets. This, cement provides a bond which fixes the casing in place and prevents any fluids moving between the casing and the borehole. This cementing process is referred to as "primary cementing".

Multiple casing sections are usually required to reach the desired well depth, and the nature of the casings used will depend on the geology of the area and the depth of the well. Typical casings used in oil or gas wells include: a conductor casing; a surface casing; one or more intermediate casings; and a production casing.

To install each subsequent casing, a smaller drilling head is lowered through the previous casing and a narrower bore is drilled through the cement at the bottom of the casing and into the ground below. As above, once the hole extends to the desired depth, the drill string and drilling head are removed and replaced with the next stage of casing, which is then cemented by the same process.

In order to ensure correct cementing, manual measurements of the properties of a test batch of cement are made in a laboratory prior to the primary cement operation. Viscosity is an important property because a cement slurry having too high a viscosity cannot be properly pumped down the casing and up into the annulus, but a cement having to low a viscosity can undesirably mix with the fluids in front of or behind the cement slurry as it is pumped down the casing.

During laboratory tests, small samples are mixed to a recipe that will be used in the cementing operation, and then tested. However, during the cementing operation itself, there is often no possibility to measure these properties because the cement is usually pumped directly into the relevant operation after production.

In some operations, one or more samples may be taken after mixing the cement slurry and before the slurry has been pumped into the well. However, these measurements may not be representative of the mixture due to variation across the volume of the cement mixture (such as due to incomplete mixing) or due to changes of the properties of the cement over time (such as due to setting of the cement).

At least the preferred embodiments of the present invention seek to solve these problems.

SUMMARY OF THE INVENTION

The present invention provides a method of monitoring one or more properties of a cement slurry during cementing of an oil or gas well, the method comprising: directing the cement slurry along a conduit to a cementing location; measuring a first pressure loss along a first portion of the conduit; and calculating a viscosity of the cement slurry based at least in part on the first pressure loss.

This method enables the automated monitoring of the viscosity of the cement slurry after the final slurry has been mixed, but before it reaches the cementing operation, and without the need for samples to be tested in a laboratory. Furthermore, the monitored value is less susceptible to inaccuracies due to changes with time, as the viscosity is measured only shortly before supply to the cementing operation, or across the volume of the cement slurry, as all of the cement slurry passing through the conduit is analysed.

Whilst the method may be applied to any well cementing operation, it is particularly applicable to primary cementing operations. Primary cementing is defined as the cementing required for constructing and drilling of a well. Other well cementing operations could, for example, include abandonment of a well or repairs to existing cementing of the well.

The calculation may further be based at least in part on a flow rate of the cement slurry along the conduit. For example, the cement slurry may be pumped along the conduit, for example using a pump. Flow rate data from the pump may be used for the calculation.

The method may further comprise: determining, based on the calculated viscosity value, the value that would be output by a rotational viscometer, and preferably a coaxial cylinder rotation viscometer testing the cement slurry. In various embodiments, the simulated viscometer may be a Couette viscometer, such as a FANN® 35 viscometer.

Many industrial standards are defined in terms of measurements output by a coaxial cylinder rotational viscometer, rather than an SI viscosity. Therefore, converting the measured viscosity into an equivalent output from a rotational viscometer (i.e. an angle) facilitates comparison of these outputs to the existing standards.

In one embodiment, the first portion of the conduit may be substantially horizontal. This configuration allows analysis of data that is independent of the density of the cement slurry, and thus facilitates the calculation of the viscosity of the slurry using only a single pressure measurement (although other measurements could still be used to refine the calculation).

Preferably, the first portion of the conduit is at an angle to the horizontal of less than 5°, and preferably less than 2°, and most preferably less than 1°.

The method preferably further comprises: measuring a second pressure loss along a second portion of the conduit, the first portion of the conduit being at a first angle with respect to horizontal and the second portion of the conduit being at a second, different angle with respect to horizontal, wherein the viscosity of the cement slurry is calculated based on the first pressure loss and the second pressure loss.

The measurement of a second pressure loss at a different angle allows the system to separate the effects of density from those of viscosity, thus enabling viscosity to be calculated without requiring additional inputs, although additional data from other sources may again still be used to refine the calculation.

The second portion of the conduit is preferably at an angle of at least 45° from the horizontal, and is preferably substantially vertical. In various embodiments, the second portion of the conduit is at an angle to the vertical of less than 5°, and preferably less than 2°, and most preferably less than 1°.

The method may further comprise: calculating a density of the cement slurry based on the first pressure loss and the second pressure loss. The use of two pressure losses allows the effects of density and viscosity to be separated. The density of the cement slurry may be another useful factor for determining abnormal cement properties.

The method preferably comprises: comparing the calculated viscosity value to a pre-determined viscosity value; and taking an action when a difference between the calculated viscosity value and the predetermined viscosity value exceeds a threshold.

Similarly, the method may comprise: comparing the calculated density value to a pre-determined density value; and taking an action when a difference between the calculated density value and the pre-determined density value exceeds a threshold.

That is to say, if an abnormal or unexpected property of the cement is detected, then suitable action may be taken. For example, the flow rate of the cement slurry may be decreased in order to reduce the shear rate of the cement slurry. In extreme cases, the action may be to stop the cementing operation. For smaller abnormalities, the action may include recording details of the abnormality for later analysis.

The method may further comprise: changing the flow rate of the cement slurry pumped along the conduit; and determining a second viscosity of the cement slurry at the new flow rate.

The cement viscosity varies with respect to its shear rate. Therefore, by changing the flow rate of the cement through the conduit, it is possible to measure the viscosity of the cement at different shear rates. This provides further information for detecting abnormal properties of the cement.

In some embodiments, the method may further comprise measuring the temperature of the cement slurry, preferably within the conduit. Viscosity varies significantly with temperature, and therefore a viscosity measurement is preferably accompanied by a corresponding temperature measurement.

In further embodiments, the method may further comprise: adjusting the calculated viscosity based on the measured temperature of the cement slurry. For example, the calculated viscosity may be adjusted to give an equivalent viscosity for a reference temperature different from the measured temperature.

Typically, the various cement standards will define the acceptable viscosity of the cement slurry at a particular reference temperature. Using known techniques and assumptions regarding viscosity variation with temperature, it is possible to use the measured temperature to determine what the equivalent viscosity of the cement slurry would be at the reference temperature, which can then be compared to the relevant standard.

Viewed from another aspect, the invention can also be seen to provide a system configured to perform the method described above. The present invention therefore also provides a system for monitoring one or more properties of a cement slurry, the system comprising: a source of cement slurry; a conduit connecting the source of cement slurry to a cementing location; a first pressure sensor configured to measure a first pressure loss along a first portion of the conduit; and a processing device configured to calculate a viscosity of the cement slurry based at least in part on the first pressure loss.

The system may comprise a pump configured to pump the cement slurry along the conduit. The calculation performed by the processing device may further be based at least in part on a flow rate of the cement slurry along the conduit. The pump may be configured to supply data representative of the flow rate of the cement slurry to the processing device.

The system may be configured to change a flow rate of the cement slurry pumped along the conduit by the pump; and the processing device may be configured to determine a second viscosity of the cement slurry at the new flow rate.

The processing device may be further configured to determining, based on the calculated viscosity value, the value that would be output by a rotational viscometer, and preferably a coaxial cylinder rotation viscometer testing the cement slurry. In various embodiments, the simulated viscometer may be a Couette viscometer, such as a FANN® 35 viscometer.

The first portion of the conduit may be substantially horizontal. Preferably, the first portion of the conduit is at an angle to the horizontal of less than 5°, and preferably less than 2°, and most preferably less than 1°.

The system may further comprise a second pressure sensor configured to measure a second pressure loss along a second portion of the conduit, the first portion of the conduit being at a first angle with respect to horizontal and the second portion of the conduit being at a second, different angle with respect to horizontal, wherein the viscosity of the cement slurry is calculated based at least in part on the first pressure loss and the second pressure loss.

The second portion of the conduit is preferably at air angle of at least 45° from the horizontal, and is preferably substantially vertical. In various embodiments, the second portion of the conduit is at an angle to the vertical of less than 5°, and preferably less than 2°, and most preferably less than 1°.

The processing device may be configured to calculate a density of the cement slurry based on the first pressure loss and the second pressure loss.

The processing device may be configured to compare the calculated viscosity value to a pre-determined viscosity value; and taking an action when a difference between the calculated viscosity value and the pre-determined viscosity value exceeds a threshold.

Similarly, the processing device may be configured to compare the calculated density value to a pre-determined density value; and taking an action when a difference between the calculated density value and the predetermined density value exceeds a threshold.

The system may further comprise a temperature sensor configured to measure the temperature of the cement slurry, preferably whilst it is within the conduit. The processing may be configured to adjust the calculated viscosity based on the measured temperature of the cement slurry. For example, the calculated viscosity may be adjusted to give an equivalent viscosity for a reference temperature different from the measured temperature.

BRIEF DESCRIPITION OF THE DRAWINGS

Certain preferred embodiments of the invention will now be described in greater detail, by way of example only and with reference to the accompanying drawings.

FIG. 1 is a schematic view illustrating a portion of an apparatus used for a primary cementing operation for an oil or gas well.

DETAILED DESCRIPTION OF PREFERRED EMBODIMENTS

In FIG. 1, an apparatus 10 is shown being used to perform a primary cementing operation for a casing 18 that has been positioned within a bore 20 of an oil or gas well 12.

A cement slurry is prepared to a pre-selected recipe and stored as a cement supply 13. From the cement supply 13, the cement slurry is then supplied to a pump 14. The pump 14 pumps the cement slurry along a conduit 16 connecting the pump 14 to the casing 18. The diameter of the conduit 16 will typically be equal to the diameter of the casing 18, but larger and smaller diameters can be used.

Disposed along the conduit are a number of sensors 22, 24, 26 for continuously monitoring properties of the cement slurry during the primary cementing operation. In this embodiment, the sensors include a first differential pressure sensor 22, a temperature sensor 24, and a second differential pressure sensor 26.

The first differential pressure sensor 22 measures the pressure drop along a first portion 28 of the conduit 16, and the second differential pressure sensor 26 measures the pressure drop along a second portion 30 of the conduit 16. The length of the portions 28, 30 can vary, but will typically be between 1 and 30 meters in length.

The angles, with respect to horizontal, of the first and second portions 28, 30 may be anywhere between 0 degrees and 180 degrees, but should be at least at different angles to one another, and these portions 28, 30 are preferably substantially horizontal and substantially vertical, respectively. In FIG. 1, the first portion 28 is oriented in an approximately horizontal direction, while the second portion 30 is oriented in an approximately vertical direction.

The data from each of the sensors 22, 24, 26, as well as data from the pump 14 are transmitted to a processing device 32. Based on at least the measurements from two differential pressure sensors 22, 26, the processing device 32 determines the density and viscosity of the cement slurry. Additional subordinate measured values may also include flow velocity (determined by the pump 14 or a flow meter) and temperature (determined by the temperature sensor 24).

The data can be analysed automatically and provide immediate warning when the cement properties deviate from the expected properties. This may indicate, for example, that the cement slurry has been insufficiently mixed or mixed to the wrong recipe, or that the cement slurry has begun to set. A decision may then be taken, either automatically or by a human supervisor, to stop the cementing operation before the anomalous cement slurry is pumped into the casing.

Cement slurry displays non-Newtonian properties, in that its viscosity varies with respect to shear rate. The various standards therefore define acceptable properties at multiple shear rates. Thus, whilst the apparatus 10 could be operated so as to analyse viscosity at only a single shear rate (which would still provide a useful safety check), the apparatus 10 could also be operated to analyse viscosity at multiple shear rates, i.e. the pump 14 can be configured to change the flow rate of the cement slurry to facilitate examination of the viscosity at multiple shear rates. In one example, the pump 14 may periodically operate at one or more different flow rates to enable viscosity measurements to be made, before returning the flow rate to normal operating conditions.

The most commonly used laboratory testing apparatuses for cement are coaxial cylinder rotational viscometers, and indeed many industry standards are defined in terms of coaxial cylinder rotational viscometer measurements. The processing device 32 is, in at least one made of operation, therefore adapted to simulate a coaxial cylinder rotational viscometer and to output viscosity measurements in a format corresponding to those that would have been output by an equivalent test of the cement slurry using a rotational viscometer. This facilitates the comparison of the output from the processing device 32 with the respective standards.

Coaxial cylinder rotational viscometers are broadly classified as "Couette" or "Searle" systems. The most common rotational viscometer is the FANN® 35 viscometer, which is a Couette coaxial cylinder rotational viscometer. In a Couette system such as the FANN® 35 viscometer, to perform a viscosity test, a test fluid sample is contained in an annular space formed between two cylinders. The outer cylinder, or rotor, is rotated at known velocities through gearing, and the viscous drag exerted by the fluid generates a torque on the inner cylinder, or bob.

The bob is supported by a torsion spring and the torque generated causes a rotational deflection of the bob, which is measured and then related to the test conditions and instrument constants. Depending on the material being tested, various rotor-bob combinations and/or torsion springs can be substituted to extend the torque measuring range or to increase the sensitivity of the torque measurement. A Searle system operates in a similar manner, except that the bob is rotated instead of the outer cylinder.

Viscosity varies significantly with temperature, and therefore cement viscosity standards are usually defined at a specific reference temperature. In practice, however, the cement being tested by the method described above will rarely be at that reference temperature, and it is therefore necessary to correct the temperature before comparison against the relevant standard.

The temperature sensor 24 is located along the conduit 16 and is configured to measure the temperature of the cement slurry within the conduit 16. This measured temperature is supplied to the processing device 32.

The processing device 32 is then configured correct the calculated viscosity that is determined based on the pressure losses measured by the differential pressure sensors 22, 26 to account for the temperature of the cement slurry, i.e. to give an equivalent viscosity at a reference temperature of the relevant standard. The equivalent viscosity can then be easily compared to the viscosity values given in the standard.

The correction of the viscosity can be carried out by the processing device 32 using known techniques and assumptions regarding viscosity variation with temperature.

In the above embodiments, two differential pressure sensors 22, 26 are used. Whilst the use of to differential pressure sensors 22, 26 is preferred, the viscosity of the cement slurry can be determined using only a single differential pressure sensor. For example, using the first differential pressure sensor 22 when the first portion 28 of the conduit 16 is substantially horizontal, the pressure loss is largely independent of gravity effects, and so the pressure loss is dominated by viscosity losses. Alternatively, the viscosity can be calculated using only the second differential pressure sensor 26 when the second portion 30 of the conduit 16 is not horizontal, but where the density is known by other means (such as based on the composition of the cement slurry or from laboratory tests, or by stopping the pump 14 such that the pressure drop is based only on density).

Furthermore, whilst the embodiment shown in FIG. 1 shows the sensors 22, 24, 26 as monitoring the main conduit 16 supplying cement slurry to the well 12, in other embodiments, the sensors 22, 24, 26 may monitor a smaller, sub-conduit carrying only a portion of the cement slurry.

The invention claimed is:

1. A method of monitoring one or more properties of a cement slurry during cementing of an oil or gas well, the method comprising:

directing the cement slurry along a conduit to a cementing location where the cement slurry sets;

measuring a first pressure loss along a first portion of the conduit;

calculating a viscosity of the cement slurry based at least in part on the first pressure loss;

measuring a temperature of the cement slurry;

adjusting the calculated viscosity based on the measured temperature to give an equivalent viscosity value for a reference temperature different from the measured temperature, comparing the equivalent viscosity value to a pre-determined viscosity value; and taking an action when a difference between the equivalent viscosity value and the pre-determined viscosity value exceeds a threshold, wherein the action is at least one of recording details of an abnormality in the difference for later analysis, decreasing a flow rate of the cement slurry in order to reduce a shear rate of the cement slurry, and stopping the cementing operation.

2. The method according to claim 1, wherein the first portion of the conduit is substantially horizontal.

3. The method according to claim 1, further comprising:

measuring a second pressure loss along a second portion of the conduit, the first portion of the conduit being at a first angle with respect to horizontal and the second portion of the conduit being at a second, different angle with respect to horizontal, wherein the viscosity of the cement slurry is calculated based on the first pressure loss and the second pressure loss.

4. The method according to claim 3, further comprising:

calculating a density of the cement slurry based on the first pressure loss and the second pressure loss.

5. The method according to claim 1, further comprising:

changing a flow rate of the cement slurry within the conduit; and determining a second viscosity of the cement slurry at the new flow rate.

6. A system for monitoring one or more properties of a cement slurry, the system comprising:

a source of cement slurry;

a conduit connecting the source of cement slurry to a cementing location where the cement slurry sets;

a first pressure sensor configured to measure a first pressure loss along a first portion of the conduit;

a processing device configured to calculate a viscosity of the cement slurry based at least in part on the first pressure loss; and a temperature sensor configured to measure a temperature of the cement slurry, wherein the processing device is configured to adjust the calculated viscosity based on the measured temperature to give an equivalent viscosity value for a reference temperature different from the measured temperature, compare the equivalent viscosity value to a pre-determined viscosity value, and take an action when a difference between the equivalent viscosity value and the pre-determined viscosity value exceeds a threshold, and wherein the action is at least one of recording details of an abnormality in the difference for later analysis, decreasing a flow rate of the cement slurry in order to reduce a shear rate of the cement slurry, and stopping the cementing operation.

7. The system according to claim 6, wherein the processing device is configured to determine, based on the calculated viscosity value, the value that would be output by a coaxial cylinder rotation viscometer testing the cement slurry.

8. The system according to claim 6, wherein the first portion of the conduit is substantially horizontal.

9. The system according to claim 6, further comprising:

a second pressure sensor configured to measure a second pressure loss along a second portion of the conduit, the first portion of the conduit being at a first angle with respect to horizontal and the second portion of the conduit being at a second, different angle with respect to horizontal, wherein the processing device is configured to calculate the viscosity of the cement slurry based on the first pressure loss and the second pressure loss.

10. The system according to claim 9, wherein the processing device is further configured to calculate a density of the cement slurry based on the first pressure loss and the second pressure loss.

11. The system according to claim 6, further comprising:

a pump for pumping the cement slurry along the conduit, the pump being configured to change a flow rate of the cement slurry within the conduit, and the processing device being configured to determine a second viscosity of the cement slurry at the new flow rate.

* * * * *